US005432966A

United States Patent [19]

Berta et al.

[11] Patent Number: 5,432,966

[45] Date of Patent: Jul. 18, 1995

[54] ADJUSTABLE AMBULANCE COT WITH TROLLEY MECHANISM

[75] Inventors: Kenneth R. Berta, Lebanon; Ronald D. Vance, Wilmington, both of Ohio

[73] Assignee: Ferno-Washington, Inc., Wilmington, Ohio

[21] Appl. No.: 147,386

[22] Filed: Nov. 3, 1993

[51] Int. Cl.[6] ..... A61G 1/00

[52] U.S. Cl. ..... 5/611; 5/11; 296/20

[58] Field of Search ..... 5/11, 610, 611, 86.1; 296/20

[56] References Cited

U.S. PATENT DOCUMENTS

| | | | |
|---|---|---|---|
| 2,675,285 | 4/1954 | Terry et al. | 5/611 X |
| 3,149,348 | 9/1964 | Hillenbrand et al. | 5/611 |
| 3,826,528 | 7/1974 | East | 296/20 |
| 4,037,871 | 7/1977 | Bourgraf et al. . | |
| 4,767,148 | 8/1988 | Ferneau et al. . | |
| 4,921,295 | 5/1990 | Stollenwerk | 296/20 |
| 5,014,024 | 5/1991 | Bloemer | 5/625 X |
| 5,015,024 | 5/1991 | Bloemer . | |

OTHER PUBLICATIONS

Ferno Model 93ES Squad-Mate Ambulance Cot Users' Manual, Ferno-Washington, Inc. Sep. 1993.

Ferno 50-2A/50-6A Transporter Owner's Manual, Ferno (UK) Limited, Oct. 1992.

Advertising Material—Super York Stretcher Cot, Patient Transfer Device.

*Primary Examiner*—Michael F. Trettel

*Attorney, Agent, or Firm*—Killworth, Gottman, Hagan & Schaeff

[57] ABSTRACT

An adjustable roll-in ambulance cot having adjusting mechanisms which require less maintenance than previous designs and which will operate smoothly and consistently in use is provided. The adjustable roll-in cot includes a cot frame having a leading end, a trailing end, and a pair of opposing side frame members. The cot is supported by leading and trailing pairs of collapsible legs having respective upper ends connected to the cot frame and lower ends including transport wheels thereon for transport of the cot. Mechanisms are also provided for adjusting the height of the cot frame relative to the transport wheels and for latching the cot frame into a plurality of predetermined positions for patient transfer and loading.

20 Claims, 5 Drawing Sheets

ADJUSTABLE AMBULANCE COT WITH TROLLEY MECHANISM

BACKGROUND OF THE INVENTION

The present invention relates to adjustable ambulance cots, and in particular to trolley and latching mechanisms for adjusting such cots to different positions.

Conventional ambulance cots are provided with wheels to enable easy movement from one location to another, including rolling the cot into and out of an emergency vehicle such as an ambulance, van, station wagon, or modified truck. In their simplest forms, such cots have nonextensible wheels mounted beneath the cot frame.

More sophisticated types of ambulance cots also exist. Elevating cots are available in which the cot frame is mounted on legs which are designed to collapse as the cot is placed in the vehicle. Cots of this type may have two positions of use, or may have multiple adjustable positions. That is, such cots have a first "down" position in which the legs are fully collapsed and an elevated "up" position in which the cot is at a standard predetermined height for transferring the patient to a bed. Cots having adjustable positioning features may be positioned at a number of intermediate heights between the fully down and up positions. Cots have also been designed so that the legs collapse as the cot is loaded into the rear of an emergency vehicle such as an ambulance.

Necessary features of adjustable cots where the legs are designed to collapse relative to the cot frame are sliding and latching mechanisms which permit movement of the cot legs relative to the frame. For example, Ferneau et al, U.S. Pat. No. 4,767,148, teach a multiple level roll-in cot having an elongated locking bar and latch pin combination which releases the cot frame for elevation and lowering.

However, many of the current adjusting mechanisms used for adjustable cots require frequent periodic maintenance, lubrication, and cleaning to avoid malfunctions. Further, many adjustable mechanisms in current use have metal-to-metal contacts which require the presence of grease so that the mechanisms will not bind during adjustment of the cot height. Greased metal parts tend to attract and hold dirt and other debris which will soil the cot mattress or sheets as well as the clothing of technicians and patients who accidentally come into contact with those greased parts. The frequent maintenance requirements to clean these mechanisms and then reapply clean lubricants are both time consuming and labor intensive. Accordingly, there is a need in this art for cot adjusting mechanisms which have fewer maintenance requirements and yet which will operate smoothly and consistently during use.

SUMMARY OF THE INVENTION

The present invention meets those needs by providing an adjustable roll-in ambulance cot having adjusting mechanisms which require less maintenance than previous designs and which will operate smoothly and consistently in use. In accordance with one aspect of the present invention, an adjustable roll-in cot is provided and includes a cot frame having a leading end, a trailing end, and a pair of opposing side frame members. The cot is supported by leading and trailing pairs of collapsible legs having respective upper ends connected to the cot frame and lower ends including transport wheels thereon for transport of the cot. A pair of loading wheels mounted adjacent the leading end of the cot frame may also be provided to aid in loading the cot into an emergency vehicle.

Means for adjusting the height of the cot frame relative to the transport wheels are also provided and include a pair of generally C-shaped channels mounted within the cot frame in opposed facing relation generally parallel to the opposing side frame members. The adjustment means also include first and second of trolley assemblies having a plurality of rollers, with the rollers positioned in opposed ones of the C-shaped channels for rolling movement therealong. In a preferred embodiment, each trolley assembly includes four rollers. The first trolley assembly is associated with the leading pair of legs, and the second trolley assembly is associated with the trailing pair of legs.

The rollers and associated bearings need no lubrication. Moreover, the rollers are preferably made of or coated with rubber for smooth, quiet operation and with no metal-to-metal contact. Because the rollers are sized and shaped to move freely within each C-shaped channel, binding of the adjustment mechanism is eliminated. Consistent operation of the cot and manipulation of the cot height are thus provided with a minimum of maintenance.

Also provided are means for latching the cot frame into a plurality of predetermined positions for patient transfer and loading. In a preferred embodiment of the invention, the means for latching the cot frame comprise a series of slots in the C-shaped channels, a lock pin assembly associated with each of the trolley assemblies including a lock pin adapted to engage individual slots in the C-shaped channels, and means for actuating each of the lock pin assemblies to withdraw individual lock pins from the slots. Preferably, a spring biases the lock pin into individual ones of the slots to provide positive latching for the legs.

The lock pin assembly also includes a load bearing pin extending substantially normal to the length of the lock pin. In a preferred embodiment, the means for actuating each of the lock pin assemblies comprise a handle or lever operatively connected through an elongated bar to a cam, whereby movement of the lever causes the cam to translate the bar against the load bearing pin to withdraw the lock pin from a corresponding slot in the C-shaped channel.

The adjustable cot of the present invention also includes an embodiment which requires the presence of two operators or technicians positioned at opposite ends of the cot to operate the height adjustment feature of the cot. In this embodiment, each of the trolley assemblies include a pair of lock pin assemblies associated with each of the trolleys. Individual ones of the lock pin assemblies face the opposing C-shaped channels, and each of the lock pin assemblies includes a lock pin adapted to engage individual slots in respective C-shaped channels. Each of the lock pin assemblies further preferably includes a load bearing pin extending substantially normal to the length of the lock pins. The means for actuating each lock pin assembly to withdraw individual lock pins from the slots comprise a pair of levers, with one lever positioned at the leading end of the cot frame and the other lever positioned at the trailing end of the cot frame. Each of the levers is operatively connected through an elongated bar to a cam, whereby movement of each of the levers causes an associated cam to translate each respective bar against a respective load bearing pin to withdraw each respective lock pin from respective ones of the slots. Both levers must be operated in order for the lock pins in the slots in each respective C-shaped channel to be withdrawn.

The trolley assemblies used in the present invention may be adapted to be used with a variety of cot constructions. Thus, the construction of the support legs for the cot may take several forms. In one embodiment, the leading pair of collapsible legs includes a first pair of frame members having first ends thereof pivotally mounted on the first trolley assembly and second ends thereof connected to respective transport wheels, and a second pair of complementary support members having first ends pivotally mounted to respective frame members and second ends thereof pivotally mounted to the cot frame. The trailing pair of collapsible legs includes a first pair of frame members having first ends thereof pivotally mounted to the cot frame and second ends thereof connected to respective transport wheels, and a second pair of complementary support members having first ends pivotally mounted to respective frame members and second ends thereof pivotally mounted to second trolley assembly.

Accordingly it is a feature of the present invention to provide an adjustable roll-in ambulance cot having adjusting mechanisms which require less maintenance than previous designs and which will operate smoothly and consistently in use. This, and other features and advantages of the present invention will become apparent from the following detailed description, the accompanying drawings, and the appended claims.

DETAILED DESCRIPTION OF THE PREFERRED EMBODIMENT

Figure 1:
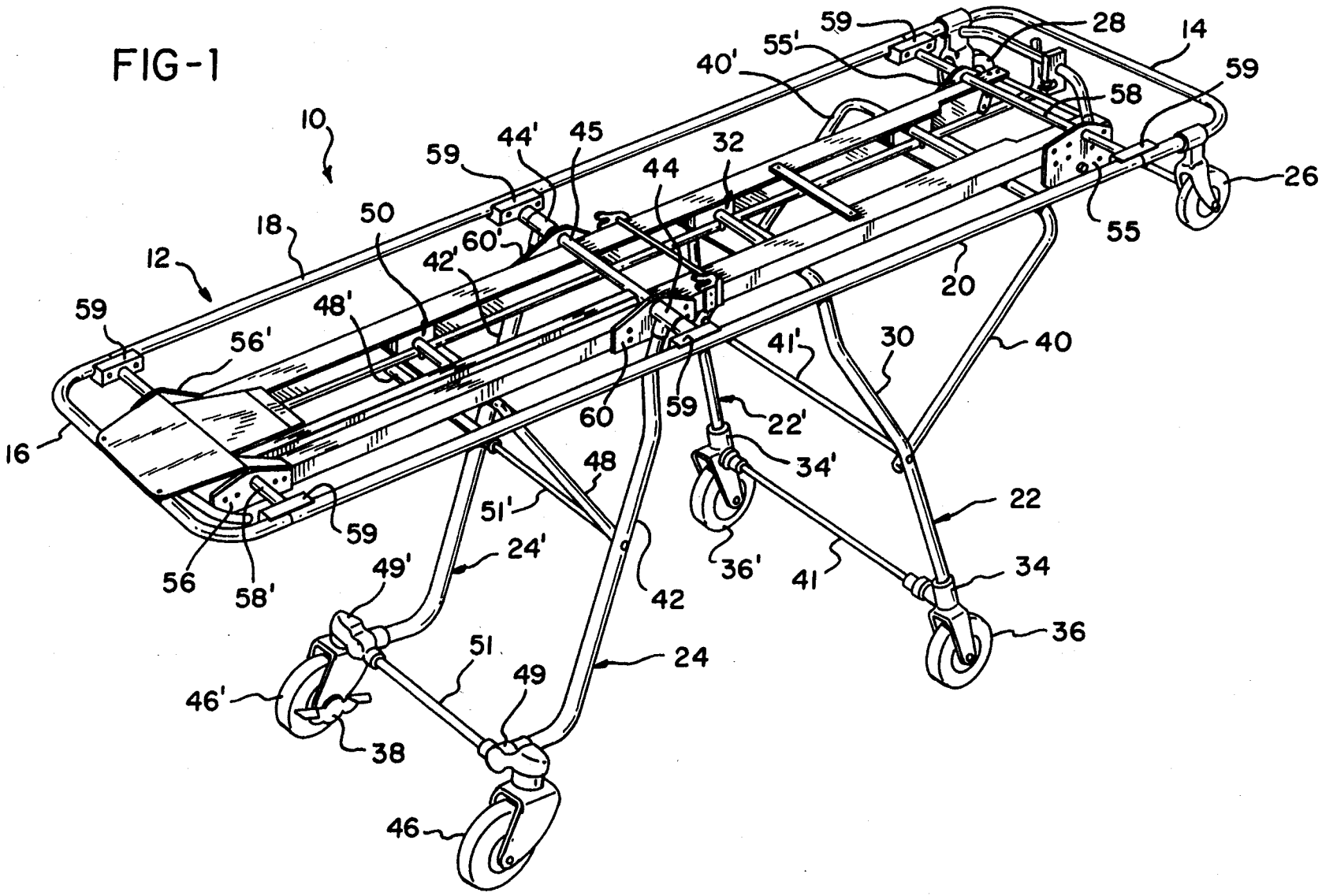
FIG. 1 is a perspective view of one adjustable cot configuration useable in the present invention.

Referring first to FIG. 1, an adjustable roll-in cot 10 is illustrated in an elevated position. It should be understood that the particular construction of the cot, including the legs, is for purposes of illustrating the trolley and latching mechanisms of the invention. The trolley and latching mechanisms may be adapted for use in any of a number of other roll-in adjustable cot configurations. However, for purposes of explanation and illustration, the cot configuration shown in FIG. 1 will be used.

Cot 10 has a frame 12 having a leading end 14, a trailing end 16, and a pair of opposed side frame members 18, 20. Typically, the frame members will be of a tubular metal and will be connected together in a conventional manner. Cot 10 is supported by leading and trailing pairs of collapsible legs 22, 22' and 24, 24', respectively. A pair of loading wheels 26, 28 are mounted using conventional hardware on side frame members 18, 20 adjacent leading end 14 of the cot frame. As is conventional in the art, these loading wheels are used when inserting the cot onto the floor of an emergency vehicle such as an ambulance.

For the particular configuration illustrated in FIG. 1, the leading pair of collapsible legs 22, 22' includes a first pair of frame members 30, 30' having first ends thereof pivotally mounted on a first trolley assembly 32. The second (opposite) ends of the frame members 30, 30' are connected, through fittings 34, 34' to transport wheels 36, 36' which may be conventional caster wheels with foot-operated locking mechanisms 38. Collapsible legs 22, 22' also include a second pair of complementary support members 40, 40' which are pivotally mounted at their first ends to respective frame members 30, 30'. The opposite ends of complementary support members are pivotally mounted to cot frame 12. The legs may include cross-supports 41, 41' for added strength and stability.

Likewise, cot 10 includes collapsible trailing legs 24, 24' which have a first pair of frame members 42, 42'. The first ends of frame members 42, 42' are pivotally mounted to cot frame 12 through rotatable fittings 44, 44'. A crosspiece 45 passes through rotatable fittings 44, 44' and is mounted to opposing side cot frame members 18 and 20, respectively. The opposite ends of frame members 42, 42' are connected to transport wheels 46, 46' through fittings 48, 48'. Collapsible legs 24, 24' also include a second pair of complementary support members 49, 49' having first ends pivotally mounted to respective frame members 42, 42'. The opposite ends of support members 49, 49' are pivotally mounted to second trolley assembly 50. Again, the trailing pair of collapsible legs 24, 24' may include cross-supports 51, 51' for added strength and stability to cot 10.

First and second trolley assemblies 32 and 50, and their construction and operation, are best illustrated in FIGS. 2 and 5–9 to which reference is now also made. The means for adjusting the height of cot frame 12 relative to the transport wheels includes a pair of generally C-shaped channels 52, 54 which are mounted within cot frame 12. By "C-shaped" it is meant that the channel has three sides, with a generally vertically oriented side and top and bottom legs which are generally horizontally oriented. Channels 52, 54 are secured to the cot frame adjacent the leading 14 and trailing 16 ends thereof using brackets 55, 55' and 56, 56' which are themselves mounted through support bars 58, 58' and secured using fittings 59 at opposing sides of frame members 18, 20. In the embodiment shown, channels 52 and 54 are also secured, through brackets 60, 60', cross piece 45, and fittings 59 to opposing sides of frame members 18, 20. While the channels 52 and 54 are described as generally C-shaped, it will be apparent that the top and bottom legs of the C need not be of identical length. In the embodiment shown, the top leg of the C is somewhat longer than the bottom leg.

Figure 5:
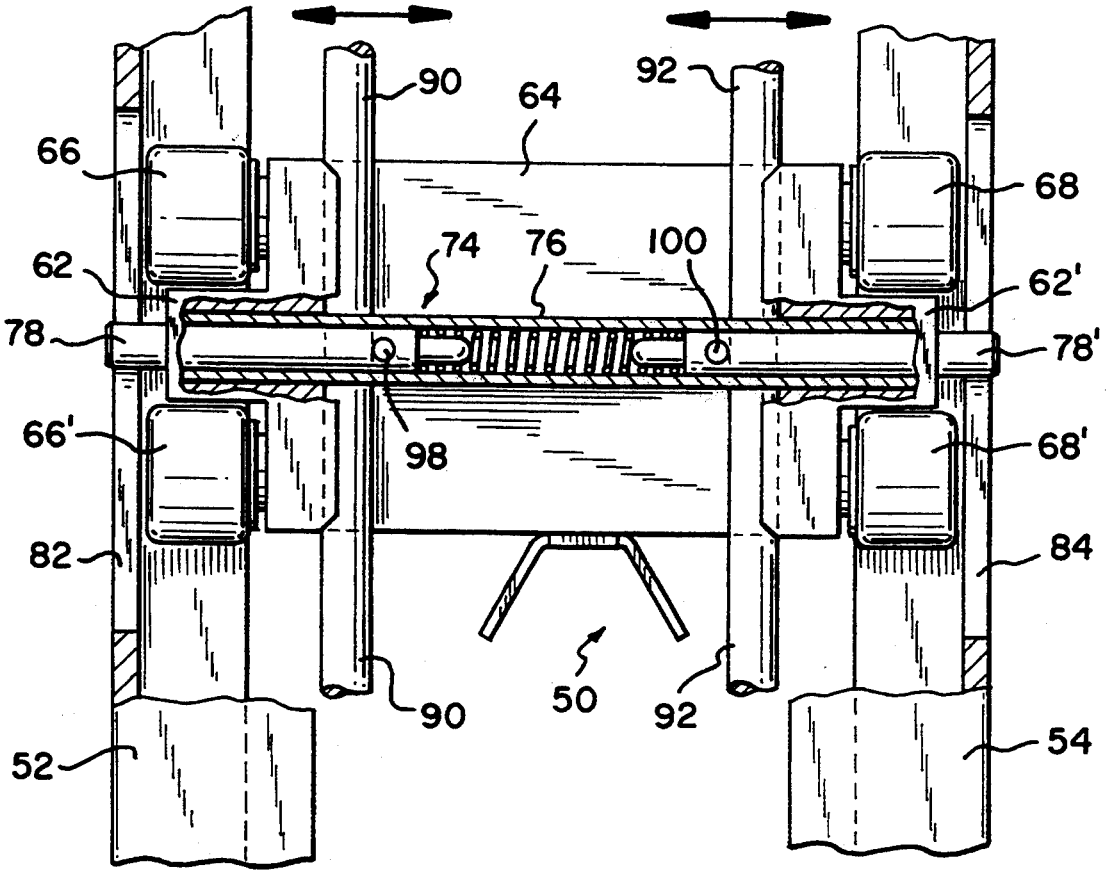
FIG. 5 is an enlarged top plan view, partially cut away, showing in greater detail the trailing end trolley including lock pin assemblies.
Figure 6:
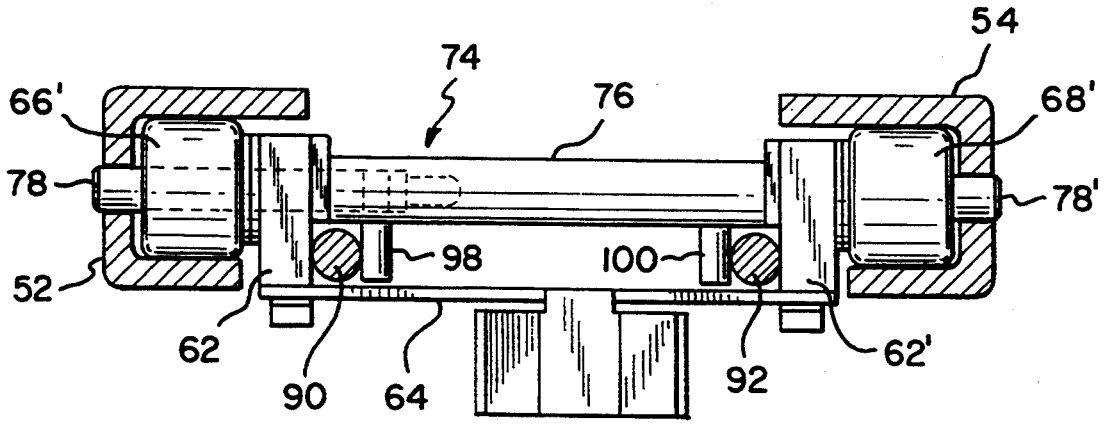
FIG. 6 is a sectional side view of the trailing end trolley mechanism of FIG. 5.
Figure 7:
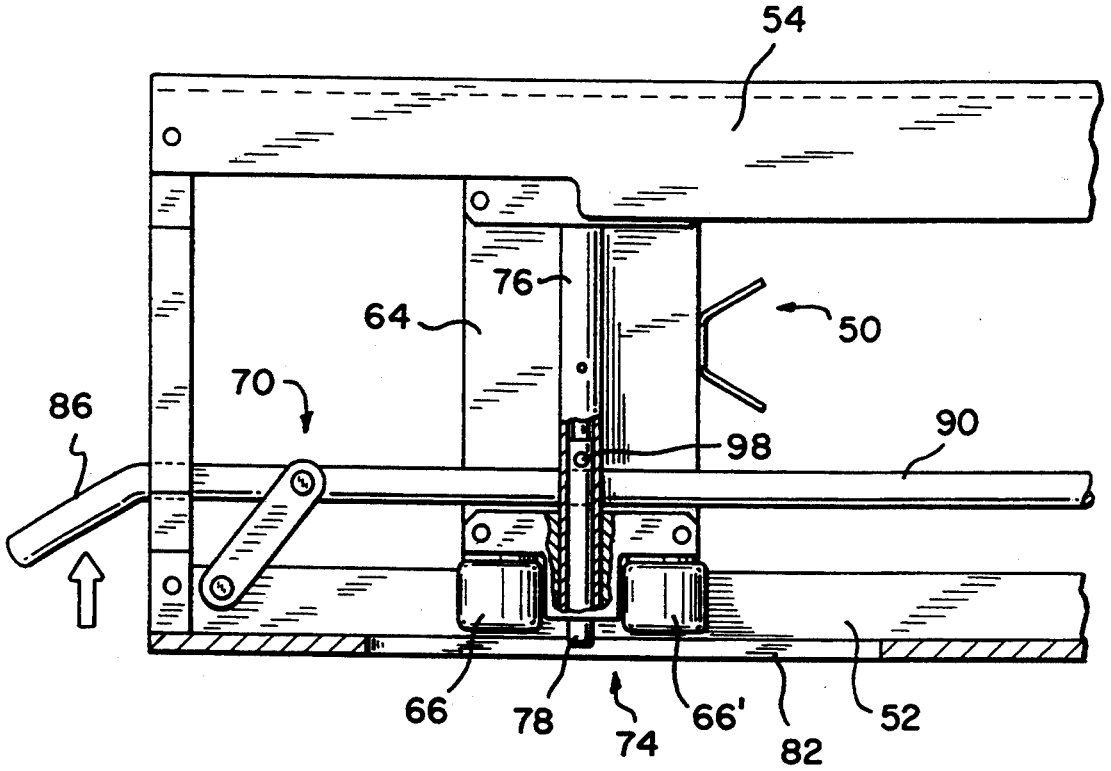
FIGS. 7 and 8 are top plan views, partially cut away, illustrating the operation of the latching mechanism of the present invention.
Figure 8:
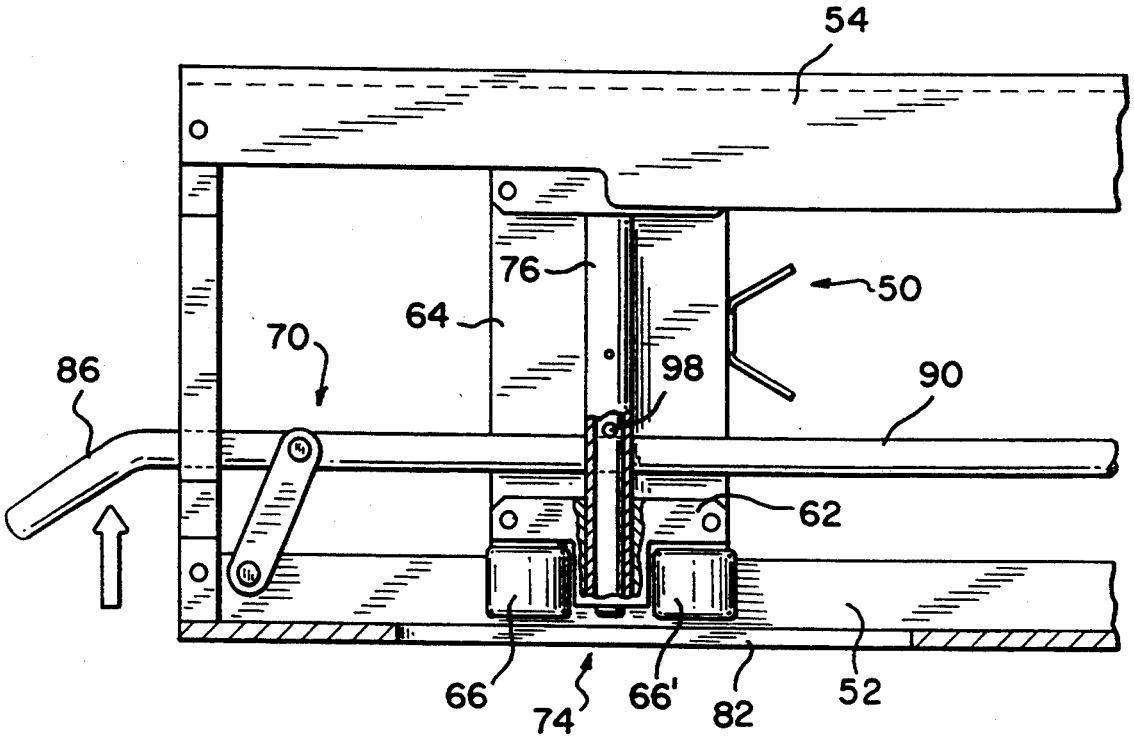
Figure 9:
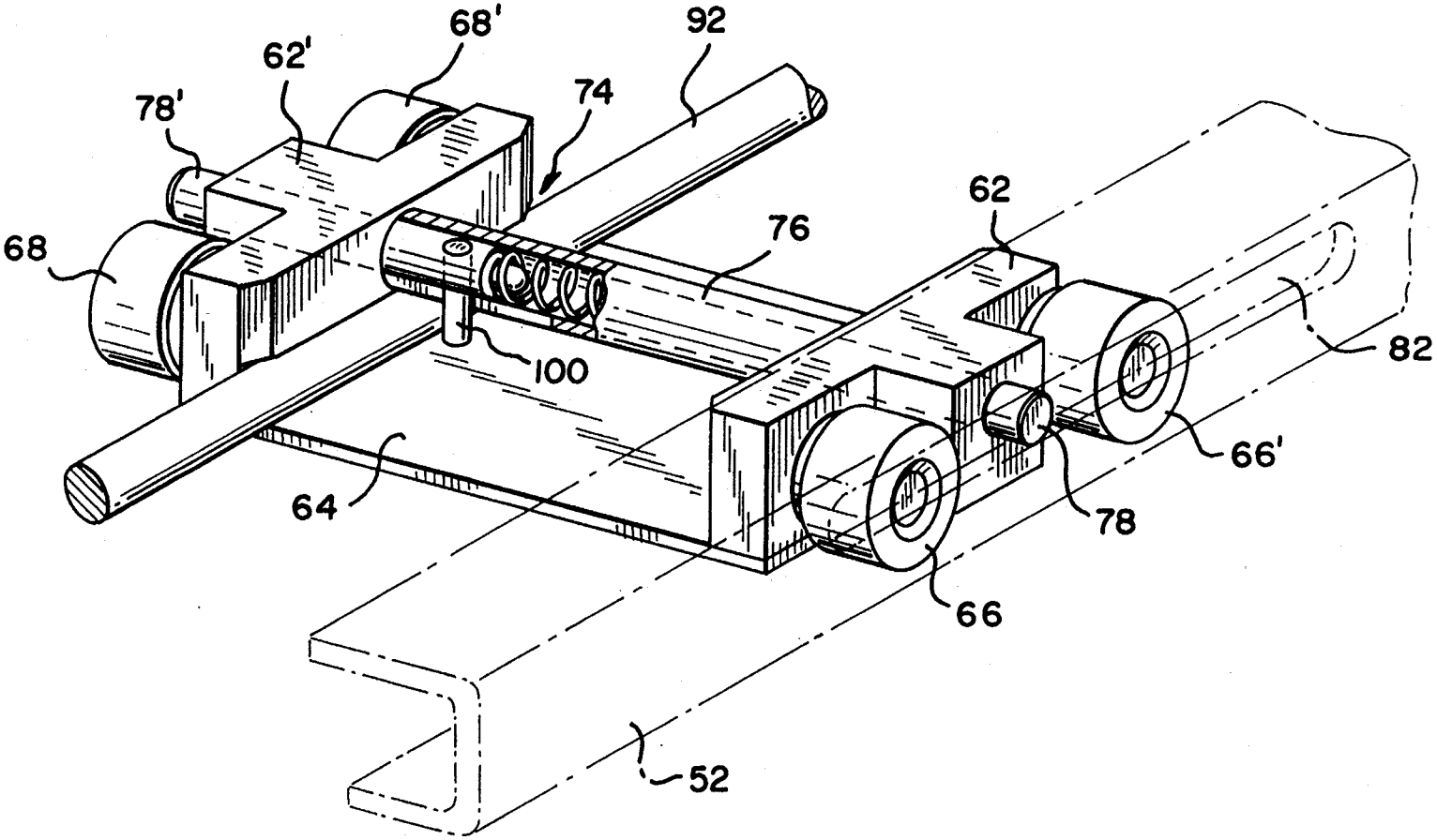
FIG. 9 is an enlarged perspective view, partially cut away and partially in phantom, showing the positioning of the trolley in a C-shaped channel in the cot frame and the operation of the lock pin assembly.

Within opposite-facing C-shaped channels 52, 54 are first and second trolley assemblies 32 and 50, respectively. As both trolley assemblies include the same basic elements, reference will be made to second trolley assembly 50 associated with trailing legs 24, 24' and as best shown in FIGS. 5 and 6 for a description of the construction and operation of both trolleys. Trolley assembly 50 includes a pair of trolley blocks 62, 62' secured to a plate 64. Each trolley block includes a pair of rollers 66, 66' and 68, 68' which are adapted to roll in opposing C-shaped channels 52, 54. The rollers are preferably constructed of rubber or are covered with rubber for smooth, quiet operation with no metal-to-metal contacts. The rollers are preferably constructed using sealed bearings which require no lubrication. As the rollers are sized and shaped to roll within the opposing C-shaped channels, binding of the adjustment mechanism is eliminated, and consistent operation is achieved with a minimum of maintenance. First trolley assembly 32 includes like elements which operate in a like manner.

Figure 4:
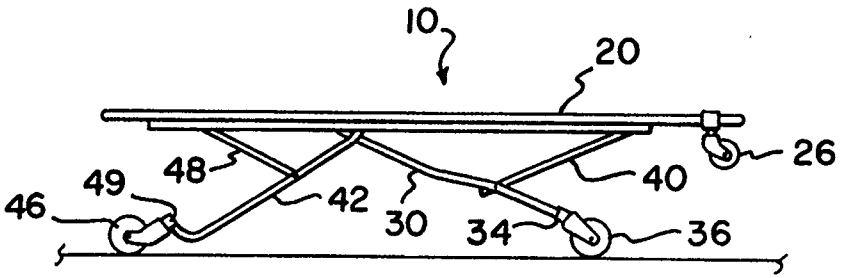
FIG. 4 is a side plan view showing an adjustable cot is a down position.
Figure 3:
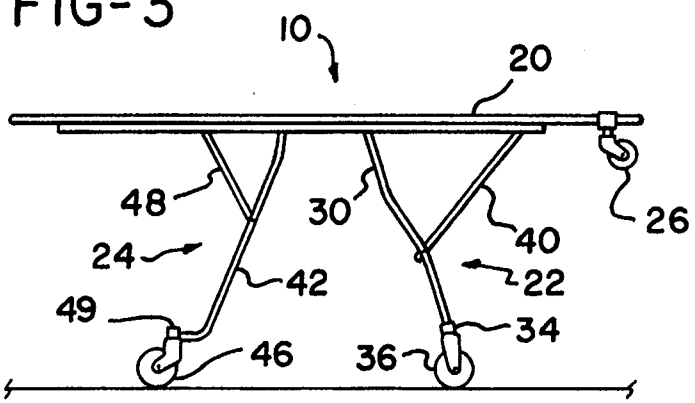
FIG. 3 is a side plan view showing an adjustable cot in an elevated position.

Included within each trolley assembly 32, 50 are latching mechanisms generally indicated at 70, 72, respectively, for the cot 10. The latching mechanisms are designed so that cot 10 may be adjusted into a number of predetermined operating positions. Two such positions are shown in FIGS. 3 and 4. In FIG. 3, cot 10 is shown in a fully elevated position for patient transport and loading into an emergency vehicle. FIG. 4 illustrates cot 10 in a lowered position from which a patient may be loaded onto the cot 10 or may be transported.

As the latching mechanisms included the same basic elements, reference will be made to latching mechanism 70 associated with second trolley assembly 50 for a description of the construction and operation of both latching mechanisms. Latching mechanism 72 includes like elements which operate in a like manner. Latching mechanism 70 includes a lock pin assembly generally indicated at 74 carried within lock pin tube 76. As shown in this embodiment, lock pin assembly 70 includes a pair of opposing lock pins 78, 78' slidably mounted within lock pin tube 76. As shown in FIG. 5, spring 80 urges the respective lock pins 78, 78' into a series of slots or holes 82, 84 in each of the opposing C-shaped channels 52, 54. Slots 82, 84 are positioned at predetermined locations as desired for adjustable positioning of cot frame 12 with respect to the cot wheels.

Figure 2:
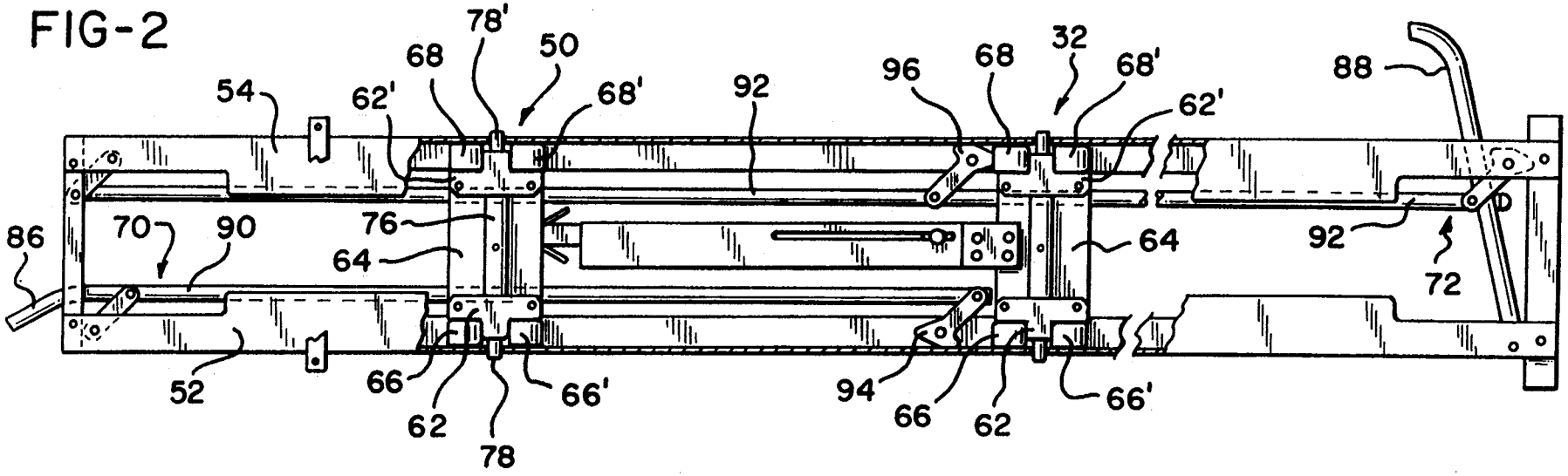
FIG. 2 is a top plan view, partially cut away, showing the trolley mechanisms of the present invention.

Lock pins 78, 78' are actuated to be withdrawn from the respective slots 82, 84 by levers or handles 86, 88 located at opposite ends of cot frame 12. As shown in FIGS. 1 and 2, removal of the lock pins from the slots in the C-shaped channels requires operators or technicians positioned at both the leading and trailing ends of cot 10. Thus, additional security is provided to insure that at least two operators are present when adjusting the height of the cot. However, it will be recognized that an adjustable cot could be designed such that a single operator could actuate single adjustment and latching mechanisms.

As shown in FIGS. 2 and 5–9, when handle 86 is pulled toward the trailing end 16 of cot frame 12, an elongated bar 90 pivotally connected thereto causes cam 94 to urge bar 90 to translate in a direction away from its at rest position adjacent C-shaped channel 52. Bar 90 bears upon a load bearing pin 98 which extends through lock pin 78 substantially normal thereto and causes lock pin 78 to be withdrawn from slot 82. Simultaneously, at first trolley assembly 32, bar 90 is causing another load bearing pin to translate and withdraw another lock pin from a corresponding slot on C-shaped channel 52.

Also as shown, at the leading end 14 of cot frame 12, another operator may actuate handle 88 by pulling it toward leading end 14. This causes a corresponding elongated bar 92 pivotally connected to handle 88 and in conjunction with a corresponding cam 96 to urge bar 92 to translate in a direction away from its at rest position adjacent C-shaped channel 54. Bar 92 bears upon a load bearing pin 100 which extends through lock pin 78' substantially normal thereto and causes lock pin 78' to be withdrawn from slot 84. Simultaneously, at first trolley assembly 32, bar 92 is causing another load bearing pin to translate and withdraw another lock pin from a corresponding slot on C-shaped channel 54.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. An adjustable roll-in cot comprising:

a cot frame having a leading end, a trailing end, and a pair of opposing side frame members;

leading and trailing pairs of collapsible legs having respective upper ends connected to said cot frame and lower ends including transport wheels thereon for transport of said cot;

means for adjusting the height of said cot frame relative to said transport wheels including a pair of generally C-shaped channels mounted within said cot frame in opposed facing relation generally parallel to said opposing side frame members, first and second of trolley assemblies having a plurality of rollers, said rollers positioned in opposed ones of said C-shaped channels for rolling movement therealong, said first trolley assembly being associated with said leading pair of legs and said second trolley assembly being associated with said trailing pair of legs; and means for latching said cot frame into a plurality of predetermined positions for patient transfer and loading.

2. An adjustable roll-in cot as claimed in claim 1 wherein said means for latching said cot frame comprise a series of slots in said C-shaped channels, a lock pin assembly associated with each of said trolley assemblies including a lock pin adapted to engage individual slots in said C-shaped channels, and means for actuating each of said lock pin assemblies to withdraw individual lock pins from said slots.

3. An adjustable roll-in cot as claimed in claim 2 wherein said lock pin assembly further includes a spring biasing said lock pin into an individual one of said slots.

4. An adjustable roll-in cot as claimed in claim 3 wherein said lock pin assembly further includes a load bearing pin extending substantially normal to the length of said lock pin.

5. An adjustable roll-in cot as claimed in claim 4 wherein said means for actuating each of said lock pin assemblies comprise a lever operatively connected through an elongated bar to a cam, whereby movement of said lever causes said cam to translate said bar against said load bearing pin to withdraw said lock pin from said slot.

6. An adjustable roll-in cot as claimed in claim 3 wherein each of said trolley assemblies include a pair of lock pin assemblies associated with each of said trolleys, individual ones of said lock pin assemblies facing opposing C-shaped channels, each of said lock pin assemblies including a lock pin adapted to engage individual slots in respective C-shaped channels, and means for actuating each lock pin assembly to withdraw individual lock pins from said slots.

7. An adjustable roll-in cot as claimed in claim 6 wherein each of said lock pin assemblies further includes a load bearing pin extending substantially normal to the length of said lock pins.

8. An adjustable roll-in cot as claimed in claim 7 wherein said means for actuating the lock pin assemblies comprise a pair of levers, with one lever positioned at said leading end of said cot frame and the other lever positioned at said trailing end of said cot frame, each of said levers being operatively connected through an elongated bar to a cam, whereby movement of each of said levers causes an associated cam to translate each respective bar against a respective load bearing pin to withdraw each respective lock pin from respective ones of said slots.

9. An adjustable roll-in cot as claimed in claim 1 wherein each trolley assembly includes four rollers.

10. An adjustable roll-in cot as claimed in claim 1 wherein said leading pair of collapsible legs includes a first pair of frame members having first ends thereof pivotally mounted on said first trolley assembly and second ends thereof connected to respective transport wheels, and a second pair of complementary support members having first ends pivotally mounted to respective frame members and second ends thereof pivotally mounted to said cot frame.

11. An adjustable roll-in cot as claimed in claim 1 wherein said trailing pair of collapsible legs includes a first pair of frame members having first ends thereof pivotally mounted to said cot frame and second ends thereof connected to respective transport wheels, and a second pair of complementary support members having first ends pivotally mounted to respective frame members and second ends thereof pivotally mounted to second trolley assembly.

12. An adjustable roll-in cot as claimed in claim 1 including a pair of loading wheels mounted adjacent said leading end of said cot frame.

13. An adjustable roll-in cot comprising:

a cot frame having a leading end, a trailing end, and a pair of opposing side frame members;

leading and trailing pairs of collapsible legs having respective upper ends connected to said cot frame and lower ends including transport wheels thereon for transport of said cot;

means for adjusting the height of said cot frame relative to said transport wheels; and means for latching said cot frame into a plurality of predetermined positions for patient transfer and loading, said means for latching said cot frame including a pair of generally C-shaped channels mounted within said cot frame in opposed facing relation generally parallel to said opposing side frame members, a first trolley assembly associated with said leading pair of legs and a second trolley assembly associated with said trailing pair of legs, a series of slots in said C-shaped channels, a lock pin assembly associated with each of said trolley assemblies including a lock pin adapted to engage individual slots in said C-shaped channels, and means for actuating each of said lock pin assemblies to withdraw individual lock pins from said slots.

14. An adjustable roll-in cot as claimed in claim 13 wherein said lock pin assembly further includes a spring biasing said lock pin into an individual one of said slots.

15. An adjustable roll-in cot as claimed in claim 14 wherein said lock pin assembly further includes a load bearing pin extending substantially normal to the length of said lock pin.

16. An adjustable roll-in cot as claimed in claim 15 wherein said means for actuating each of said lock pin assemblies comprise a lever operatively connected through an elongated bar to a cam, whereby movement of said lever causes said cam to translate said bar against said load bearing pin to withdraw said lock pin from said slot.

17. An adjustable roll-in cot as claimed in claim 14 wherein each of said trolley assemblies include a pair of lock pin assemblies associated with each of said trolleys, individual ones of said lock pin assemblies facing opposing C-shaped channels, each of said lock pin assemblies including a lock pin adapted to engage individual slots in respective C-shaped channels, and means for actuating each lock pin assembly to withdraw individual lock pins from said slots.

18. An adjustable roll-in cot as claimed in claim 17 wherein each of said lock pin assemblies further includes a load bearing pin extending substantially normal to the length of said lock pins.

19. An adjustable roll-in cot as claimed in claim 18 wherein said means for actuating the lock pin assemblies comprise a pair of levers, with one lever positioned at said leading end of said cot frame and the other lever positioned at said trailing end of said cot frame, each of said levers being operatively connected through an elongated bar to a cam, whereby movement of each of said levers causes an associated cam to translate each respective bar against a respective load bearing pin to withdraw each respective lock pin from respective ones of said slots.

20. An adjustable roll-in cot as claimed in claim 13 wherein said means for adjusting the height of said cot frame relative to said transport wheels include said C-shaped channels, first and second of trolley assemblies having a plurality of rollers, said rollers positioned in opposed ones of said C-shaped channels for rolling movement therealong.

* * * * *